US005511603A

United States Patent [19]

Brown et al.

[11] Patent Number: 5,511,603

[45] Date of Patent: Apr. 30, 1996

[54] MACHINABLE METAL-MATRIX COMPOSITE AND LIQUID METAL INFILTRATION PROCESS FOR MAKING SAME

[75] Inventors: Alexander M. Brown, Wilmington, Del.; Eric M. Klier, Catonsville, Md.

[73] Assignee: Chesapeake Composites Corporation, New Castle, Del.

[21] Appl. No.: 262,075

[22] Filed: Jun. 16, 1994

Related U.S. Application Data

[63] Continuation of Ser. No. 38,129, Mar. 26, 1993, abandoned.

[51] Int. Cl.[6] ..... B22D 19/14

[52] U.S. Cl. ..... 164/97; 164/98

[58] Field of Search ..... 164/97, 98, 91, 164/76.1

[56] References Cited

U.S. PATENT DOCUMENTS

| | | | |
|---|---|---|---|
| 3,547,180 | 12/1970 | Cochran | 164/97 |
| 3,574,609 | 4/1971 | Finlay et al. | 428/614 |
| 3,600,163 | 8/1971 | Badia et al. | 164/97 |
| 3,718,441 | 2/1973 | Landingham | 501/94 |
| 3,758,298 | 9/1973 | Eppich | 164/97 |
| 3,853,635 | 12/1974 | Demendi | 164/120 |

(List continued on next page.)

FOREIGN PATENT DOCUMENTS

| | | | |
|---|---|---|---|
| 0280830 | 9/1988 | European Pat. Off. | 164/100 |
| 62-161461 | 7/1987 | Japan | 164/97 |
| 8103295 | 11/1981 | WIPO | 164/100 |

OTHER PUBLICATIONS

Pressure Infiltration Casting of Metal Matrix Composites A. J. Cook, Mat'l Science & Engineering A144 (Oct. 1991) 189–206.

Shanker et al., "Properties of TaC–Based Metal–Matrix Composites Produced By Melt Infiltration," *Composites,* vol. 23, No. 1 (Jan. 1992), pp. 47–53.

Lane, "The Effect Of Different Reinforcements On PCD Tool Life For Aluminum Composties," *Proceedings of the Machining of Composite Materials Symposium, ASM Materials Week,* Chicago, Illinois, 1–5 Nov., 1992, Ed. T. S. Srivasan, pp. 17–27.

Jawaid et al., "Drilling Of Particulate Aluminum Silicon Carbide Metal Matrix Composites," *Proceedings of the Machining of Composite Materials Symposium, ASM Materials Week,* Chicago, Illinois, 1–5 Nov., 1992, Ed. T. S. Srivasan, pp. 35–47.

Orsborn, et al., "Machining Experinece With Discontinuosly Reinforced Aluminum Hydraulic Components," *Proceedings of the Machining of Composite Materials Symposium, ASM Materials Week, Chicago, Illinois, 1–5 Nov., 1992, Ed. T. S. Srivasan, pp. 57–61.*

Lane, "Machining Characteristics Of Particulate–Reinforced Aluminum," *Proceedings of an International Conference,* Montreal, Canada, Jul. 29, 1990, pp. 195–201, ASM International, Materials Park, Ohio 44073.

(List continued on next page.)

*Primary Examiner*—P. Austin Bradley
*Assistant Examiner*—Randy Herrick
*Attorney, Agent, or Firm*—Bacon & Thomas

[57] ABSTRACT

Metal-matrix composites and methods for producing these composites are provided. The manufacturing methods include providing a ceramic preform having a uniform distribution of ceramic particles sintered to one another. The particles include an average particle size of no greater than about 3 microns, and at least one half of the volume of the preform is occupied by porosity. The preform is then disposed into a mold and contacted by molten metal. The molten metal is then forced into the pores of the preform and permitted to solidify to form a solid metal-matrix composite. This composite is machinable with a high-speed steel (HSS) bit for greater than about 1 minute without excessive wear occurring to the bit. This invention preferably employs metal-matrixes including Al, Li, Be, Pb, He, Au, Sn, Mg, Ti, Cu, and Zn. Preferred ceramics include oxides, borides, nitrides, carbides, carbon, or a mixture thereof. Inert gas pressures of less than about 3,000 psi can be used to easily infiltrate the preforms.

21 Claims, 1 Drawing Sheet

U.S. PATENT DOCUMENTS

| | | | |
|---|---|---|---|
| 3,885,959 | 5/1975 | Badia et al. | 428/614 |
| 3,907,514 | 9/1975 | Demendi | 164/97 |
| 3,936,298 | 2/1976 | Mehrabian et al. | 164/900 |
| 4,007,062 | 2/1977 | Sifferien | 148/437 |
| 4,292,079 | 9/1981 | Pickens et al. | 148/440 |
| 4,379,719 | 4/1983 | Hildeman et al. | 420/550 |
| 4,540,546 | 9/1985 | Giessen | 164/463 |
| 4,566,519 | 1/1986 | Ban et al. | 164/112 |
| 4,586,554 | 5/1986 | Tank et al. | 164/97 |
| 4,587,707 | 5/1986 | Nishida et al. | 164/55.1 |
| 4,617,053 | 10/1986 | Joó | 75/244 |
| 4,623,388 | 11/1986 | Jatkar et al. | 420/528 |
| 4,710,348 | 12/1987 | Brupbacher | 420/129 |
| 4,731,132 | 3/1988 | Alexander | 428/614 |
| 4,759,995 | 7/1988 | Skibo et al. | 420/590 |
| 4,786,467 | 11/1988 | Skibo et al. | 428/614 |
| 4,812,289 | 3/1989 | Alexander | 420/590 |
| 4,828,008 | 5/1989 | White et al. | 164/66.1 |
| 4,834,810 | 5/1989 | Benn et al. | 148/437 |
| 4,916,030 | 4/1990 | Christodoulou et al. | 428/614 |
| 4,961,461 | 10/1990 | Klier et al. | 164/461 |
| 4,973,522 | 11/1990 | Jordan et al. | 428/614 |
| 5,006,417 | 4/1991 | Jackson et al. | 428/614 |
| 5,106,702 | 4/1992 | Walker et al. | 428/614 |
| 5,111,871 | 5/1992 | Cook | 164/63 |
| 5,114,505 | 5/1992 | Mirchandani et al. | 148/437 |
| 5,143,795 | 9/1992 | Das et al. | 428/614 |
| 5,167,920 | 12/1992 | Skibo et al. | 428/614 |
| 5,196,273 | 3/1993 | Tsantrizos et al. | 428/614 |

OTHER PUBLICATIONS

Lane, "Drilling And Tapping SiC Particle–Reinforced Aluminum," *Proceedings of the ASM 1993 Materials Congress, Pittsburgh, Pennsylvania, Oct. 17–21, 1993, pp. 9–16.*

Burkes et al., "Advanced Tooling And Technology For Drilling Metal–Matrix Composite Materials," *Proceedings of the ASM 1993 Materials Congress,* Pittsburgh, Pennsyvlania, Oct. 17–21, 1993, pp. 31–42.

Leep et al., "Production Driling Models For A Composite Material," *Proceedings of the ASM 1993 Materials Congress,* Pittsburgh, Pennsylvania, Oct. 17–21, 1993, pp. 131–135.

Duggan et al., "Aluminum Composite Driveshafts," *Automotive Engineering,* Feb. 1994, pp. 87–90.

Chadwick et al., "Machining Metal Matrix Composites," *Metals and Materials,* Feb. 1990, pp. 73–76.

Brun et al., "Wear Characteristics Of Various Hard Materials For Machining SiC–Reinforced Aluminum Alloy," *Wear,* 104 (1985) pp. 21–29.

Chambers et al., "Machining Of Al–5Mg Reinforced With 5 vol. % Saffil And 15 vol. % SiC," *Materials Science and Engineering,* (1991) pp. 287–290.

Zimmerman et al., "Machinability Test Methods," *Machining of Specific Metals and Alloys,* pp. 639–647.

Kendall, "Tool Wear And Tool Life," *Fundamentals of the Machining Process,* pp. 37–48.

Machinability, Machinability Data Center, *Machining Data Handbook,* 3rd Edition (1980), pp. 40–66.

Koczak et al., "Chapter 16—Metal–Matrix Composites For Ground Vehicle, Aerospace, And Industrial Applications," *Fundamentals of Metal–Matrix Composites* (1993), pp. 297–326.

Cook et al., "Pressure Infiltration Casting Of Metal Matrix Composites," *Materials Science and Engineering,* (1991), pp. 189–206.

Alcoa Deltalloy 4032™, Product Specifications, Alcoa Wire, Rod and Bar Division, New York.

Kalpakjian, "Manufacturing Processes For Engineering Materials," Addison–Wessley, Reading, Mass., 1985, Chapters 8, 9 and 13.

Eric Klier, "Fabrication of Cast Particulate Reinforced Metals Via Pressure Infiltration", Theisis for Master's Program, Massachusetts Institute of Technology (Dec., 1986).

Brown et al., "Crack Growth and Fracture Properties of Rapidly Solidified Al–Fe–V–Si Alloys", *Aluminum Alloys Their Physical and Mechanical Properties,* vol. II, pp. 1029–1038 (Jun., 1986).

Adam and Lewis, "High Performance Aluminum Alloys", *Rapidly Solifidied Crystalline Alloys,* pp. 157–183 (May, 1985).

Zedalis et al., "High Temperature Discontinuously Reinforced Aluminum", *Proceedings, Twelfth Annual Discontinuously Reinforced MMC Working Group Meeting,* MMCIAC No. 718, pp. 27–1 to 27–13 (Jul., 1990).

Klier and Brown, "Oxide Dispersion Strengthened Magnesium Piston Alloy", *Abstracts of Phase I Awards, NSF Small Business Innovation Research Program (SBIR),* p. 21 (Jun., 1992).

Klier et al., "Fabrication of cast particle–reinforced metals via pressure infiltration", *Journal of Materials Science,* vol. 26, pp. 2519–2526 Dec., 1991).

Yang and Chung, "Casting particulate and fibrous metal–matrix composites by vacuum infiltration of a liquid metal under an inert gas pressure", *Journal of Materials Science,* vol. 24, pp. 3605–3612 Dec., 1989).

Ray and Yun, "Squeeze–Cast $Al_2O_3$/Al Ceramic–Metal Composites", *Ceramic Bulletin,* vol. 70, No. 2, pp. 195–197 Dec., 1991).

Zedalis et al., "High Temperature Aluminum–Base Composites", *High Performance Composites for the 1990's,* pp. 61–81 Dec., 1991).

A. Mortensen, "Solidification Processing of Reinforced Metals", *Metal Matrix Composites—Processing, Microstructure and Properties,* Proceedings of the 12th Riso International Symposium on Material Science, pp. 101–121 Dec., 1991).

Ibrahim et al., "Particulate reinforced metal matrix composites—a review", *Journal of Materials Science,* vol. 26, pp. 1137–1156 Dec., 1991).

Rohatgi et al., "Solidification, structures, and properties of cast metal–ceramic particle composites", *International Metals Reviews,* vol. 31, No. 3, pp. 115–139 Dec., 1986).

Caron and Masounave, "A Literature Review on Fabrication Techniques of Particulates Reinforced Metal Composites", pp. 79–86 (undated).

Schoutens and Tempo, "Composite Materials", *Introduction to Metal Matrix Composite Materials,* MMCIAC Tutorial Series, MMC No. 272, pp. 2–1 to 2–51 Dec., 1982).

*The Journal of The Minerals, Metals & Materials Society,* vol. 45, No. 1, pp. 1–44 (Jan., 1993).

*The Journal of The Minerals, Metals & Materials Society,* vol. 43, No. 8, pp. 1–32 (Aug., 1991).

Lane, "Machining Characteristics of Particulate–Reinforced Aluminum", pp. 195–201 (undated).

Letter from Andreas Mortensen to Alex Brown dated Jan. 7, 1990 (with attachments) outlining the research project for developing Chesapeake Composites' materials using MIT facilities.

Letter from Warren H. Hunt, Jr. to Eric Klier dated Jan. 16, 1991 (submitting proposed DOE Metals Initiative Proposal).

Letter from Thomas B. Gurganus and Warren H. Hunt, Jr. to

Alex Brown dated Mar. 14, 1991 (submitting revised DOE Proposal entitled "High Volume Fraction Particle Reinforced Metals for Structural Applications in the Internal Combustion Engineer").

Draft proposal from Alex Brown to David R. Williams dated Mar. 28, 1991.

Letter from Eric Klier to Tadahiko Nohira dated Aug. 29, 1991 (suggesting the suitability of Chesapeake Composites' composite for automobile pistons).

Letter from Alex Brown to David C. Dunand dated Oct 22, 1991 (concerning joint research efforts).

Business Plan Summary from Chesapeake Composites to Per Baverstam dated Nov., 1991 (for the purpose of obtaining venture capital).

Technology Overview entitled "Dispersion Strengthened Light–Metal Composites" from Chesapeake Composites to Tusit Weerasooriya dated Nov., 1991 (for the purpose of developing opportunities for Chesapeake Composites' materials for Army technology).

Letter from David C. Dunand to Eric Klier and Alex Brown dated Nov. 11, 1991 (further elaborating on joint research objectives).

Letter from Alex Brown to William Quist dated Feb. 25, 1992 (inquiring about possible teaming opportunities with Boeing).

Letter from Alex Brown to William Quist dated Feb. 28, 1992 (inquiring how to apply Chesapeake Composites' technology to HSCT developmemts at Boeing).

Letter from Alex Brown to David Dunand dated Mar. 21, 1992 with attachment (sending two data plots showing elevated temperature performance of Chesapeake Composites' aluminum DSC material).

MACHINABLE METAL-MATRIX COMPOSITE AND LIQUID METAL INFILTRATION PROCESS FOR MAKING SAME

This is a Continuation application of application Ser. No. 08/038,129, filed Mar. 26, 1993, now abandoned.

FIELD OF THE INVENTION

This invention relates to the manufacture of metal-ceramic composites having a high tensile modulus, good ductility, toughness, formability, and machinability, and more particularly, to light-weight, metal-matrix composites, including uniformly distributed ceramic particles which increase the mechanical properties of the composite without significantly reducing its ductility and machinability.

BACKGROUND OF THE INVENTION

Metal matrix composites (MMCs) are metals or alloys strengthened with tiny inclusions of another material which inhibit crack growth, and increase performance. MMCs have mechanical properties that are superior to those of most pure metals, some alloys, and most polymer-matrix composites, especially at high temperatures. The ability to tailor both mechanical and physical characteristics of MMCs is a unique and important feature of these materials.

Although the technology is relatively young, there are a number of significant applications, most notably, the space shuttle fuselage struts, space telescope boom-waveguides, and diesel engine pistons. In the future, metal-matrix composites are expected to become an important class of materials in numerous other commercial applications.

Although many metal-matrix composites having widely different properties exist, some general advantages of these materials over competing materials can be cited. MMCs are known to have higher strength-to-density ratios and higher stiffness-to-density ratios with better fatigue resistance than most unreinforced metals and some polymer matrix composites.

Numerous combinations of matrixes and reinforcements have been attempted since work on metal matrix composites began in the late 1950's. The most important matrix materials have been aluminum, titanium, magnesium, copper, and superalloys. Particular metal matrix composites that have been employed in the art have included aluminum matrixes containing boron, silicon carbide, alumina, or graphite in continuous fiber, discontinuous fiber, whisker, or particulate form. Magnesium, titanium, and copper have also been used as matrix metals with similar ceramic inclusions. Additionally, superalloy matrixes have been impregnated with tungsten wires to provide greater creep resistance at extremely high temperatures, such as those found in jet turbine engines.

Fabrication methods are an important part of the design process for MMCs. Considerable work is underway in this critical area, and significant improvements in existing processes appear likely. Current methods can be divided into two major categories: primary and secondary fabrication methods. Primary fabrication methods are used to create the metal matrix composite from its constituents. The resulting material may be in the form that is close to the desired final configuration, or it may require considerable additional processing, called secondary fabrication. Some of the more popular secondary fabrication methods include forming, rolling, metallurgical bonding, and machining.

One of the more successful techniques for producing MMCs, first suggested by Toyota for making pistons in 1983, is by infiltrating liquid metal into a fabric or prearranged fibrous configuration called a preform. Frequently, ceramic and/or organic binder materials are used to hold the fibers in position. The organic materials are then burned off before or during metal infiltration, which can be conducted under a vacuum, positive pressure, or both. One commonly employed pressure infiltration technique, which is known to reduce porosity in the final composite, is referred to as squeeze-casting.

The squeeze-casting process usually consists of placing a fiber or whisker preform in a cavity of a die, adding molten metal, and infiltrating the preform with the metal by closing the die and applying high pressure with a piston. The process is typically used for near net shaped parts of small dimensions. See Siba P. Ray and David I Yun, "Squeeze-Cast $Al_2O_3$/Al Ceramic-Metal Composites," *Ceramic Bulletin*, Vol. 70, No. 2 (1991).

Although Ray and Yun suggest that ceramic matrix composites can be manufactured using preforms composed of alumina particles of 0.2 micron average particle size and including 14 to 48% open pores, this disclosure is limited to the production of ceramic-matrix composites (CMCs) having severely limited toughness, ductility, and machinability. Their set-up requires the use of expensive, heavy-walled dies and presses designed to withstand large pressure differentials, such as a 1,500-ton press.

It is also known to produce metal matrix composites by squeeze-casting followed by a secondary fabrication procedure, as suggested by Nishida et al., U.S. Pat. No. 4,587,707. In this process, squeeze-casting is used to infiltrate a porous shaped article of ceramic particles with a molten metal, which is then permitted to solidify. High pressures of 500 to 1,000 atmospheres (15,000 to 150,000 psi) were believed to be required for complete infiltration. The ceramic particles are provided by slender rods and are not uniformly distributed in the matrix. Since these concentrated layers of ceramic in the metal matrix are not intended to be present in the final product, mechanical forming is used to break up the rods into smaller pieces and distribute them throughout the matrix. The suggested rolling or extrusion techniques help to spread the now broken ceramic preforms more randomly throughout the composite; however, the result is far from a uniform distribution on a microscopic scale. Since the sintered ceramic rods are likely to be fractured in a non-uniform manner during the mechanical forming step, the resulting composite may contain concentrated, or agglomerated ceramic regions, which could limit the resulting composite's properties.

To alleviate the need for large pressure requirements, most known metal infiltration procedures use large particulate ceramics, greater than about 1 micron. Molten metal infiltration has not been considered a practical process for making metal-matrix composites incorporating submicron ceramic particles because the press size and pressure needs would be excessive and unrealistic. See Christodoulou et al., U.S. Pat. No. 4,916,030, Col. 2, lines 25–38.

In order to dispense with the limitations and expense of large multi-ton presses, others have employed inert gas pressure metal infiltration techniques with loose ceramic powders. See Jingyu Yang and D. D. L. Chung, "Casting Particulate and Fibrous Metal-Matrix Composites by Vacuum Infiltration of a Liquid Metal Under an Inert Gas Pressure," *Journal of Materials Science*, Vol. 24, p.p. 3605–3612 (1989). Yang and Chung have developed a low pressure (1,000 to 2,500 psi) molten metal infiltration technique that employs pressurized inert gas for forcing molten metal into loose ceramic fibers or particles. Particles ranging in size from 0.05 to 5 microns are used. By limiting the particles to a specific size range, this reference teaches that greater porosity in the close-packed particles can be provided, since the gaps between the particles are not filled by significantly smaller particles. It is this porosity volume fraction that is relied upon to permit the low pressure force to cause the molten liquid to infiltrate the loose layers of ceramic particles. Unfortunately, since the particles are loose and not sintered, they tend to agglomerate and randomly orient themselves during metal infiltration. This results in a relatively non-uniform distribution of particles throughout the matrix. Despite the expedient of using less pressure, therefore, the composite produced by infiltrating loose particles fails to achieve its full ductility and strength.

Metal-matrix composites are not without other well-recognized drawbacks. The ceramic inclusions used to strengthen these composites are extremely hard, and are difficult to machine using conventional techniques. This results in serious tool-wear problems when the composite is machined into its final configuration. In some cases, the tool-wear becomes such a serious problem, that manufacturers resort to near-net shape manufacturing techniques, such as die casting and squeeze-casting, and the like, where machining is kept to a minimum, or is eliminated altogether. As reported in Charles T. Lane's "Machining Characteristics of Particulate-Reinforced Aluminum," Fabrication of Particulates Reinforced Metal Composites, Proceedings of an International Conference, Montreal, Quebec, Canada, ASM International, pp. 195–201 (1990), aluminum alloys reinforced with 10 to 15 micron ceramic particles wore through high-speed steel (HSS) tools in a matter of seconds, and dulled conventional and coated carbides in a matter of a few minutes. This paper reported that the only cost-efficient machining technique for MMCs was to use polycrystalline diamond (PCD) tools at speeds of up to 2,438 meters per minute. Other artisans have had similar experiences with machining MMCs, which has obviously limited their full commercial implementation.

Accordingly, there is a need for further process developments for manufacturing metal-matrix composites which have superior strength and uniformity, but which are also easy to machine and manufacture. There also remains a need for economically producing metal-ceramic composites without expensive heavy press machinery, or complicated processing techniques.

SUMMARY OF THE INVENTION

This invention provides metal-matrix composites and methods for their manufacture. The methods of this invention include providing a ceramic preform containing ceramic particles of average particle size, i.e. its diameter or largest cross-sectional dimension, no greater than about 3 microns. These tiny ceramic particles are distributed uniformly throughout the preform and are sintered to one another so that at least about one half of the volume of the preform is occupied by porosity. The inventive method includes the steps of placing the ceramic preform into a mold and contacting it with a molten metal. The molten metal is then forced into the preform so as to penetrate therethrough and occupy the pores. Finally, the molten metal is solidified to form a solid metal-matrix composite. In an important aspect of this invention, the resulting composite is machineable, and preferably, can be machined with a high-speed steel (HSS) tool bit for greater than about 1 minute without excessive wear to the bit.

Accordingly, this invention combines the high strength, stiffness, and wear resistance of ceramics with the machinability, toughness, and formability of metals. A small characteristic reinforcement size of less than about 3 microns, and preferably less than about 1 micron, in conjunction with a large volume fraction of porosity and a substantially uniform distribution of ceramic particles in a sintered preform are all employed to provide these composites. The composites of this invention provide improved room and elevated temperature strengths, increased modulus, and, unexpectedly, excellent machinability and ductility, even at high ceramic loadings. These composites have been machined using only high-speed steel (HSS) milling, drilling, and tapping tooling without experiencing any difficulty. Excellent surface finishes were produced.

The MMCs of this invention exhibit high strength at room and elevated temperatures, since the small reinforcement size and interparticle spacing meets the criteria for dispersion strengthening. The small uniformly distributed ceramic particles permit the composite to behave much more like a metal than a typical MMC, permitting their use in applications requiring greater ductility, toughness, and formability. The particular metal infusion procedures of this invention are adaptable to multiple alloy and ceramic pairings and permit greater latitude for increasing the tensile modulus, as loadings approach 50 vol. %. Specific reinforcement ceramics and volume fractions can be selected which will permit designable engineered properties dictated by the application, including high elastic modulus, strength, and ductility.

In more preferred embodiments of this invention, other critical parameters are suggested, including preform porosities within the range of about 50 to 80 vol. %, a minimum preform compressive strength of about 500 psi, and the selection of preferred ceramic and metal alloy combinations for providing light-weight, high modulus composites. In the preferred manufacturing aspects of this invention, very low gas pressures can be used instead of a piston, to permit greatly facilitated processing of these composites without large capital expenditures. These processes can produce both bulk billets and near-net shape articles made from submicron sized particles by using pressures of less than about 3,000 psi. These processes are therefore inexpensive, and employ readily-available raw materials and otherwise standard liquid metal infusion techniques. All of these expedients can be accomplished by using a very uniform distribution of small reinforcement ceramics in a preform having readily infiltrated porosity.

DETAILED DESCRIPTION OF THE INVENTION

Figure 1:
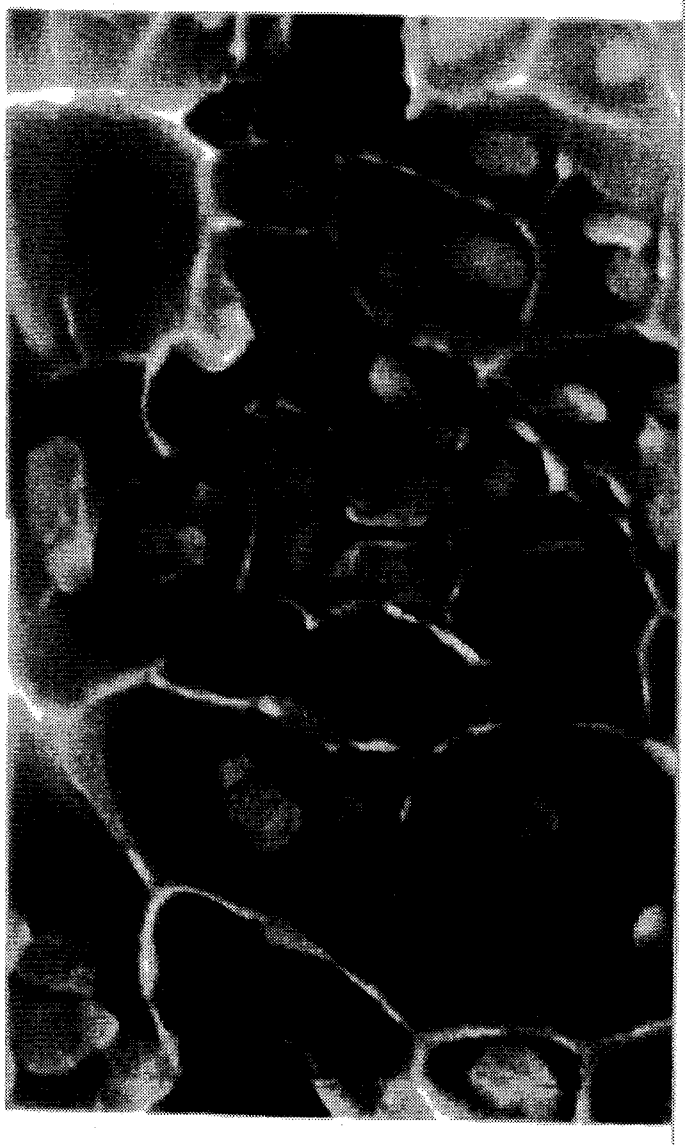
FIG. 1: is a photomicrograph taken at 35,000× magnification of an alumina-reinforced aluminum matrix composite manufactured by the preferred liquid metal infiltration techniques disclosed herein.

Machinable metal-matrix composites are provided by this invention which are derived from combining ceramic particles of no greater than about 3 microns with molten metal in an extremely uniform manner. By employing smaller ceramic particles, preferably of submicron size, and distributing them throughout a metal-matrix so as to avoid agglomeration, both high ductility and strength can be provided to the composite without limiting machinability. In preferred embodiments of this composite, at least 80% of the ceramic particles are uniformly distributed on a scale of three times the particle diameter or largest cross-sectional dimension, and more preferably, at least 90% of the ceramic particles are uniformly distributed on a scale of twice the particle diameter or largest cross-sectional dimension. (Such measurements are made by microscopic inspection of two-dimensional polished samples. It is understood that, despite this two-dimensional spacing, the particles touch one another in three dimensions to form a stable preform). This degree of fine particle distribution virtually eliminates large inclusions and agglomerations which detract from the ductility, strength, and machinability of the composite.

Although this invention relates to all types of metal-ceramic composites, including ceramic-matrix composites (CMCs), it is particularly applicable to metal-matrix composites (MMCs) having a larger volume fraction of metal than ceramic. These MMCs can be made from many different combinations of matrix material and reinforcing particles to develop whatever special set of properties is required for each application.

This invention contemplates employing ultra-high strength metal matrixes including those having a yield strength of about 70 to 2,000 MPa. Such metals include, for example, cobalt and its alloys, martensitic stainless steels, nickel and its alloys, and low-alloy hardening steels. High strength metals and alloys are also potential candidates for the matrixes of this invention, including tungsten, molybdenum and its alloys, titanium and its alloys, copper casting alloys, bronzes, coppers, niobium and its alloys, and superalloys containing nickel, cobalt, and iron. Medium strength metals and alloys can also be considered, including hafnium, austenitic stainless steels, brasses, aluminum alloys between 2,000 and 7,000 series, beryllium-rich alloys, depleted uranium, magnesium alloys, silver, zinc die casting alloys, coppers, copper nickels, copper-nickel-zincs, and other metals having a yield strength of about 40 to 690 MPa. Finally, this invention optionally employs low strength, low density alloys for the matrixes of this invention. Such metals are represented by gold, cast magnesium alloys, platinum, aluminum alloys of the 1,000 series, lead and its alloys, and tin and its alloys. These materials have a yield strength of only about 5 to 205 MPa. Most desirably, this invention employs light-weight metals and those which are relatively inexpensive and widely available, such as aluminum, lithium, beryllium, lead, tin, magnesium, titanium, and zinc, and metals which have superior electrical properties, such as copper, silver, and gold. All of these selections can be provided in commercially pure, or alloyed, form. Specific alloys which have been recognized to have particular usefulness in MMCs include Al-1 Mg-0.6 Si, Al-7 Si-1 Mg, Al-4.5 Cu, Al-7 Mg-2 Si, and Al-Fe-V-Si.

Although alloys and commercially pure metals can be employed to produce the matrixes of this invention, a pure metal is the matrix of choice, since ceramic dispersion strengthening is all that is required for improved properties. A pure metal also offers enhanced corrosion resistance over alloys, and eliminates the effects of overaging of precipitates. Pure metals also boost elevated temperature capability by increasing the homologous melting point over comparable alloys. Finally, pure metals eliminate the difficulties associated with microsegregation and macrosegregation of the alloying elements in non-eutectic alloys during solidification.

The ceramic or second phase constituents of the metal matrix composites of this invention are desirably of a size which does not interfere with machining by HSS tooling. It has been discovered that machinability can be preserved only if these ceramic particles are less than about 3 microns, although this invention preferably employs a size range of about 0.01 to 0.5 microns. The ceramic particles should be thermally and chemically stable for the time and temperature of the particle fabrication process and environmental conditions of service.

These ceramic particles should not decompose at high temperatures, nor react with the metal matrix. If they tend to diffuse into the matrix, diffusion of the reinforcement must be slow, so that the strength of the composite does not seriously degrade. Ultra-fine reinforcement particles having a volume fraction of about 20 to 40% are particularly advantageous in yielding composites with improved Young's modulus, ductility, and machinability.

Exemplary second phase ceramic candidates include borides, carbides, oxides, nitrides, silicates, sulfides, and oxysulfides of elements which are reactive to form ceramics, including, but not limited to, transition elements of the third to sixth groups of the Periodic Table. Particularly useful ceramic-forming or intermetallic compound-forming constituents include aluminum, titanium, silicon, boron, molybdenum, tungsten, niobium, vanadium, zirconium, chromium, hafnium, yttrium, cobalt, nickel, iron, magnesium, tantalum, thorium, scandalum, lanthanum, and the rare earth elements. More exotic ceramic materials include titanium diboride, titanium carbide, zirconium diboride, zirconium disilcide, and titanium nitride.

Carbon-based ceramics can also be useful as the ceramic phase, including natural and synthetic diamonds, graphite, fullerenes, diamond-like graphite, etc. Certain ceramics, because of their availability, ease of manufacture, low cost, or exceptional strength-inducing properties, are most desirable. These include $Al_2O_3$, SiC, $B_4C$, MgO, $Y_2O_3$, TiC, graphite, diamond, $SiO_2$, $ThO_2$, and $TiO_2$. These ceramic particles desirably have an aspect ratio of no greater than about 3:1, and preferably no greater than about 2:1, but can be represented by fibers, particles, beads, and flakes, for example. However, particles are preferred for machinability.

Alternatively, the ceramic reinforcements of this invention can have aspect ratios ranging from equiaxed, to platelets and spheredized configurations. The particle size distribution can range from mono-sized, to a gausean distribution, or a distribution having a wide tail at fine sizes. These particles can be mixed using a variety of wet and dry techniques, including ball milling and air abrasion.

The preferred binders employed in connection with the ceramic reinforcements can include: inorganic colloidal and organic binders, such as, sintering binders, low temperature (QPAC), and high temperature colloidal binders. Such binders have included polyvinyl alcohol, methyl cellulose, colloidal alumina, and graphite.

Metal-matrix composites made in accordance with this invention and containing one or more of the above metals, alloys, and ceramic particles, can be fabricated into many useful configurations for a variety of applications. Some of the more interesting applications appear below in TABLE I.

TABLE I

| Representative Metal-Ceramic Composites and Potential Applications | | |
|---|---|---|
| Matrix | Fiber | Potential Applications |
| Aluminum | Graphite | Satellite, missile, and helicopter structures |
| Magnesium | Graphite | Space and satellite structures |
| Lead | Graphite | Storage-battery plates |
| Copper | Graphite | Electrical contacts and bearings |
| Aluminum | Boron | Compressor blades and structural supports |
| Magnesium | Boron | Antenna structures |
| Titanium | Boron | Jet-engine fan blades |
| Aluminum | Borsic | Jet-engine fan blades |
| Titanium | Borsic | High-temperature structures and fan blades |
| Aluminum | Alumina | Superconductor restraints in fusion-power reactors |
| Lead | Alumina | Storage-battery plates |
| Magnesium | Alumina | Helicopter-transmission structures |
| Aluminum | SiC | High-temperature structures |
| Titanium | SiC | High-temperature structures |
| Superalloy (Co-base) | SiC | High-temperature engine engine components |
| Superalloy | Molybdenum | High-temperature engine components |
| Superalloy | Tungsten | High-temperature engine components |

The performance of the resulting composites of this invention is intimately linked to the uniformity of the preform used in the preferred metal infiltration procedures. These preforms can be made by a variety of procedures including sediment casting, injection molding, gel casting, slip casting, isopressing, ultrasonic techniques, filtering, extruding, pressing, and the like. Preferably, colloidal processing is employed to make the preforms. Volatile additions and controlled agglomeration of the slurries can be used to adjust particle volume fraction within the desired ranges.

Following the preparation of a green preform, the preform is preferably dried, or fired. This can be accomplished by microwave processing, freeze drying, or air/inert gas firing. Test bars can also be prepared along with the preform so that a determination of the modulus of rupture, or tensile properties, can be evaluated prior to pressure infiltration. A target compressive strength of at least about 500 psi, and preferably about 700 to 1,200 psi, is desirable for the sintered preform.

The preforms of this invention are ideally pressure infiltrated with liquid metal to produce billets or shaped articles. Pressure infiltration can include all types of liquid metal infiltration (LMI) processes, including: inert gas pressure techniques, squeeze casting, and die casting, etc. In a most preferred procedure, inert gas pressure infiltration is employed. This technique includes the key steps of: evacuation of the preform prior to infiltration, adequate pressure control for infiltration without preform disruption, and directional solidification under pressure to feed solidification shrinkage.

In a mass production environment, fabrication of large-sized billets could be followed by wrought processing to common product forms. Pressure infiltration coupled with wrought processing offers a potential of low cost, high performance composite manufacturing for a wide variety of structural applications. Wrought processing can include such procedures as: extrusion, rolling, forging, etc. Net shape processing can also be employed, including: die casting and squeeze casting. In these latter procedures, large billets, due to the inherent stability of the claimed composites, can be remelted and processed in the liquid state to produce near net shape components. Approximate properties for an aluminum and magnesium matrix MMC prepared by the preferred processes of this invention are included below in TABLE II.

TABLE II

| Approximate Physical Properties of Dispersion Strengthened Aluminum and Magnesium | | |
|---|---|---|
| | Aluminum 25% Alumina | Magnesium* 20% Diamond |
| Density | 3.00 g/cc | 2.00 g/cc |
| Tensile Strength | 60 ksi | 55 ksi |
| Vickers Hardness | 120 MPa | 110 MPa |
| Young's Modulus | 18 msi | 22 msi |

*Proposed example

Applicants have evaluated the preferred loading ranges for the MMCs of this invention, and have determined that a 15 vol. % ceramic loading improves the modulus of commercially pure aluminum and magnesium by about 30%. A 25 vol. % of ceramic particles improves the modulus by about 50 to 60%, and a 55 vol. % ceramic loading improves the modulus by about 100%, but ductility begins to suffer. Ceramic loadings of up to 45 vol. % produced MMCs which were machined with high speed steel without significant wear. It was further noted that when ceramic particles exceeded about 3 microns, the machinability of the MMC decreased dramatically. With respect to the volume fraction, it was further noted that ceramic loadings greater than about 50% significantly lowered the ductility of the composite, and loadings significantly below 15 vol. % produced no significant modulus boost. Lower loadings were also very difficult to infiltrate, since the preforms were too weak to sustain infiltration pressures without disruption.

The present invention will be further described with reference to the following examples.

EXAMPLE I

A composite material was prepared having a commercially pure Al matrix including 25 vol. % $Al_2O_3$, about 0.2 micron average particle size on a population basis. As a preliminary step, the raw materials were weighed out as follows:

Reinforcement: A-16SG, calcined $Al_2O_3$, Alcoa Industrial Chemical Division, 259.8 grams.

Carrier: POLAR distilled water, Polar Water Company, 1205.8 grams.

Filler: Micro 450 (M-450) graphite, Asbury Graphite Mills, Inc., 184.6 grams

Colloidal Binder: Inorganic NYACOL, AL20, high temperature coating/binder, Nyacol Products, Inc., 86.0 grams.

This mixture was combined in a mill using the following mill parameters: slurry solids content of 10% and mill fill level of 30%. The slurry batch was milled for about 23 to 25 hours, removed from the mill, and disposed in a pressure filtration unit. The slurry was filtrated at 350 psi for about 36 to 60 hours. When filtration was complete, the green preform was removed from the filtration unit. It was measured to have dimensions of about 4.9 cm in diameter×12 cm long. The green preform had a reinforcement loading of about 22 vol. %. The green preform was then dried at ambient conditions until a weight loss of at least about 25 wt. % had been achieved. This took about five days.

The dry preform was then placed in a furnace and fired according to the following schedule:

| Ramp Seq. | Ramp Rate (°C./hr) | Ramp Time (hr) | Hold Temp (°C.) | Hold Time (hr) |
|---|---|---|---|---|
| 1/2 | 25 | 14 | 325 | 2 |
| 3/4 | 50 | 12 | 900 | 30 |
| 5/6 | 50 | 6 | 1,200 | 1.5 |
| 7/8 | 100 | 12 | 22 | 24 |

The fired preform had a loading of about 25 vol. % of sintered ceramic particles. It was removed and inspected, and a weight loss of about 40 wt. % was noted. This weight loss insured that all filler material had been removed.

A mild steel infiltration crucible was then prepared by coating with a graphite wash coating DAG 154 Graphite Lubricating/Resistance Coating, available from Achesion Colloids Company. The interior of the crucible was then lined with GRAFOIL graphite paper, Grade GTB available from UCAR Carbon Company, Inc. The fired preform was then inserted into the lined crucible and a preform support rod was inserted to prevent floating. The crucible was then inserted into the pressure infiltration unit, which was custom built. The pressure infiltration unit was evacuated, and then preheated using the following heat cycle:

| Ramp Seq. | Ramp Time (hr) | Hold Temp (°C.) | Hold Time (hr) |
|---|---|---|---|
| 1/2 | 2 | 200 | 0:05 |
| 3/4 | 8 | 700 | 2 |

Approximately 650 grams of commercially pure aluminum (99.9% aluminum, 2 to 5 shot available from Alcoa) was then melted in an electrical resistance furnace and covered with Flux No. 770 Cover Flux, available from Asbury Graphite Inc. The infiltration unit was then back-filled with argon. The crucible was removed from the pressure infiltration unit, and the molten alloy was poured into the crucible which caused the argon bubble to the top of the crucible. The crucible was then placed into the pressure infiltration unit, and it was again evacuated. After evacuation, the unit was pressurized with argon to about 2,150 psi in about 40 to 80 seconds and held for five minutes. The unit was then vented, and the crucible was placed onto a water-cooled chill at the bottom of the pressure infiltration unit. The unit was once again repressurized to 1,000 psi for solidification. The mixture was permitted to cool for about one hour until directionally solidified. The sample was removed from the pressure infiltration unit, the crucible was cut off, and the alloy head was removed.

Under a scanning electron microscope, a fracture surface of one sample of the above composite was visually inspected at 35,000×. The micrograph is shown in FIG. 1. The observed particle size was found to be about 0.05 to 0.4 microns, with 0.2 microns being typical, and an interparticle spacing of about 0.05 to 0.4 microns was measured.

The following mechanical properties were measured after two samples were removed from the resulting billet:

Yield Strength (ksi)=24.7

Ultimate Tensile Strength (ksi)=48.0

Elongation=6.0

1.00-SR, Short Rod Fracture Toughness=16.5 KSi(IN)$^2$

Others samples were extruded at 825° F., and further samples were prepared for hardness, tensile and fatigue properties, with the following results:

| Hardness | |
|---|---|
| As extruded | Rb 57 |
| As solutionized (940 F./1 hr/WQ) | Rb 59 |
| Solutionized (940 F./1 hr/WQ) plus Age (400 F./2 hr/AC) | Rb 56 |

| Hot Hardness | | |
|---|---|---|
| Temperature, °F. | Load, Kg | BHN |
| RT | 750 | 103 |
| RT | 500 | 99.3 |
| 300 | 500 | 68.7 |
| 500 | 500 | 46.1 |
| 600 | 500 | 41.6* |

| Tensile Properties | | | |
|---|---|---|---|
| Property | RT | 300° F. | 500° F. |
| UTS-KSI | 49.9 | 35.6 | 24.7 |
| YS-KSI | 29.5 | 27.5 | 22.9 |
| % El. | 11 | 11 | 12 |
| % RofA | 17 | 17 | 15.5 |

| Smooth Fatigue | | |
|---|---|---|
| Stress, KSI | Temperature, °F. | Cycles to Failure X 10E6 |
| 20 | 500 | 0.335 |
| 15 | 500 | 0.690 |
| 10 | 500 | 187.5 |

*Indentor bottomed

EXAMPLE II

A composite material was prepared using an Al-2.5 Mg matrix having 25 vol. % fraction $Al_2O_3$ particles, about 0.2 micron average particle size on a population basis, using the same procedure as described in Example I, except the matrix included 5052-H32 Al-2.5 Mg alloy, in the form of a 0.249 cm×48 cm×24 cm plate. The process parameters were identical, except the Al-2.5 Mg alloy was substituted for the commercially pure aluminum. No cover flux was used during melting of the alloy, and the hold temperature during infiltration was about 695° C. The following properties were obtained using some of the same testing procedures as disclosed in Example I:

Sonic Modulus (MSI)=15.85

Poisons Ratio=0.318

Density (g/cm$^3$)=3.023

| Test Temp (°F.) | Uniform Elongation % | Plastic Elongation % | U.T.S. (KSI) | Y.S. (KSI) |
|---|---|---|---|---|
| 77 | 6.33 | 6.514 | 56.47 | 46.66 |
| 200 | 5.20 | 8.68 | 48.64 | 38.43 |
| 300 | 4.78 | 16.2 | 39.77 | 10.21 |
| 77* | 3.92 | 3.948 | 56.94 | 46.66 |

*Tested after 300° F./100 hrs exposure

EXAMPLE III

A composite material was prepared which included a commercially pure Al matrix including 40 vol. % $Al_2O_3$, 0.2 micron average particle size on a population basis. The raw materials of Example I were the same except for the fact that an organic binder, AIRVOL 540, polyvinyl alcohol, from Chemicals Group Sales of Air Products and Chemical, Inc. was employed, and a colloidal chemistry adjustment was made which included the addition of nitric acid, 69.0 to 71.0%, BAKER ANALYZED Reagent, $HNO_3$, from VWR Scientific. As with previous examples, the dried ingredients were weighed out as follow:

Reinforcement: A-16 SG calcined $Al_2O_3$, 633.0 grams.

Carrier: POLAR Distilled Water, 920.7 grams.

Filler: Micro 450 (M-450) graphite, 104.5 grams.

Organic Binder: (6 wt. % solution in water), AIRVOL 540, 30.1 grams.

Colloidal Chemistry Adjuster: nitric acid, 0.4 ml.

This mixture was combined in a similar milling procedure as was used in Example I with the following mill parameters: slurry solids content of 17.5% and mill fill level of 25%. The slurry batch was milled for about 23 to 25 hours, removed from the mill, and disposed in a pressure filtration unit.

The slurry was filtrated at 350 psi for about 20 to 30 hours. When filtration was complete, the green preform, 37 vol. % ceramic, was removed from the filtration unit. It was measured to have dimensions of 4.9 cm in diameter×14 cm long. The green preform was then dried at ambient conditions until a weight loss of at least 23 wt. % had been achieved. This took about five days.

The dried preform was then placed in a furnace and fired according to the following schedule:

| Ramp Seq. | Ramp Rate (°C./hr) | Ramp Time (hr) | Hold Temp (°C.) | Hold Time (hr) |
|---|---|---|---|---|
| 1/2 | 25 | 14 | 325 | 2 |
| 3/4 | 50 | 12 | 900 | 30 |
| 5/6 | 50 | 4 | 1,100 | 2 |
| 7/8 | 100 | 11 | 22 | 24 |

The fired preform had a loading of about 40 vol. % of sintered ceramic particles. It was removed and inspected, and a weight loss in excess of about 15 wt. % was noted.

A mild steel infiltration crucible was then prepared, inserted into the infiltration unit and evacuated in accordance with substantially the same procedure as described for Example I. The unit was thereafter preheated using the following heat cycle:

| Ramp Seq. | Ramp Time (hr) | Hold Temp (°C.) | Hold Time (hr) |
|---|---|---|---|
| 1/2 | 2 | 200 | 0:05 |
| 3/4 | 8 | 700 | 2 |

Approximately 600 grams of commercially pure aluminum, as used above in Example I, was then melted, and inert gas infiltration was used to prepare a composite substantially in accordance with the procedures of Example I.

The following mechanical properties were measured:

Material Condition: As Cast
- Sonic Modulus (MSI)=17.7
- Poisons Ratio=0.288
- Density (g/cm$^3$)–3.113

Material Condition: Extruded
- Ultimate Tensile Strength (ksi)=65
- Elongation=4

Hardness
- 70 Rb

EXAMPLE IV

A composite material was prepared having a commercially pure Mg matrix including 30 vol. % MgO ceramic particles, about 0.8 micron average particle size (about 0.2 micron after milling). The raw materials employed were the same as those used in Example I with the following exceptions: the reinforcement included MAGCHEM 20-M, technical grade magnesium oxide from Martin Marietta Magnesia Specialties, Inc.; the carrier employed was denatured ethanol from E.K. Industries, Inc.; the organic binder was Bulls Eye Shellac, Clear Sealer and Finish, from Williams Zinsser & Co., Inc., and the matrix consisted of commercially pure magnesium, 99.8 wt. % magnesium, 1 pound sticks, 1.3 inch diameter×12 inch in length.

The raw materials were weighted out as follows:

Reinforcement: MAGCHEM 20-M magnesium oxide, Martin Marietta Magnesia Specialties, Inc., 232.3 grams.

Carrier: POLAR Distilled Water, 727.2 grams.

Filler: Micro 450 (M-450) graphite, 89.6 grams.

Organic Binder: Bulls Eye Shellac, 116.4 grams.

This mixture was combined in a mill using the following mill parameters: slurry solids content of 10% and mill fill level of 25%.

The slurry batch was milled according to the milling procedures of Example I. When filtration was complete, the green preform was removed from the filtration unit. It was measured to have dimensions of about 4.9 cm diameter×10 cm long. The green preform had a reinforcement loading of about 26 vol. %, and was then dried at ambient conditions until a weight loss of at least about 25 wt. % had been achieved. This took about five days.

The dried preform was then placed in a furnace and fired according to the following schedule:

| Ramp Seq. | Ramp Rate (°C./hr) | Ramp Time (hr) | Hold Temp (°C.) | Hold Time (hr) |
|---|---|---|---|---|
| 1/2 | 25 | 14 | 325 | 6 |
| 3/4 | 50 | 14 | 700 | 30 |
| 5/6 | 50 | 4 | 1,100 | 1 |
| 7/8 | 100 | 12 | 22 | 24 |

The fired preform had a loading of about 29 vol. % of sintered ceramic particles. It was removed and inspected, and a weight loss of at least about 34 wt. % was noted.

An infiltration crucible was prepared and set up substantially as described for Example I. Approximately 300 grams of matrix magnesium alloy was deposited on the top of the preform and preform support rod. The crucible was inserted into the pressure infiltration unit, the unit was evacuated and backfilled to an argon pressure of about 300 psi. The unit was then preheated using the following heat cycle:

| Ramp Seq. | Ramp Time (hr) | Hold Temp (°C.) | Hold Time (hr) |
|---|---|---|---|
| 1/2 | 2 | 200 | 0:05 |
| 3/4 | 8 | 705 | 2 |

After the two-hour hold at about 705° C., the unit was evacuated. After evacuation, it was pressurized with argon to about 2,150 psi and held for five minutes. The directional solidification and removal steps were substantially the same as those described above for Example I. Samples were prepared and a hardness value of 65 Rb was measured. Hot hardness values substantially paralleled the trend for the aluminum-matrix samples.

Machinability Test

Samples were prepared from the Al/25 vol. % $Al_2O_3$ (Example I); Al/40 vol. % $Al_2O_3$ (Example II); Al-2.5 Mg/25 vol. % $Al_2O_3$ (Example III); and Mg/30 vol. % MgO (Example IV).

Each of the samples was subjected to the following machining operations with the noted results:

Face milling and end milling was preformed with HSS tooling. No difficulty was experienced using approximately 30 sfm speeds and up to about ¼ inch roughing cuts. The surface finish was good.

Drilling was performed with uncoated regular-twist HSS drills without problems. The drill was operated at about 100 sfm. Drilling holes from about 1/32 inch diameter up to about ⅝ inch diameter were made with no apparent limitation in the depth.

Tapping was performed with an uncoated 3 flute HSS tap, tapped by hand to sizes ranging from about ⅛ inch to about ¾ inch course and fine threads. No difficulty was encountered.

Samples prepared from the Al/25 vol. % $Al_2O_3$ and Al-2.5 vol. % Mg/25 vol. % $Al_2O_3$ were turned on a lathe at about 350 sfm using a solid carbide tool bit. The tool bit removed at least 6 cubic inches of material and operated for at least three hours without difficulty.

An Al/40 vol. % $Al_2O_3$ sample was turned on a lathe at about 350 sfm using a HSS tool bit. The tool bit removed at least about 3 cubic inches of material and operated for at least two hours without difficulty. Good to excellent surface finishes were obtained.

COMPARATIVE EXAMPLE V

Drilling was performed using a 356-T6 Al-matrix reinforced with 20 vol. % SiC (10 to 15 micron average particle size), (DURALCAN F3A.20S). The drilling operation was preformed with a ¼ inch HSS drill bit using a hand drill. The drill bit penetrated about ¼ inches and was dulled to the point where it required sharpening to be used again.

An attempt was made to cut this material using a band saw. The saw penetrated about ¼ inches and then stopped. Both of these hand drilling and band saw techniques were later duplicated on an Al/25 vol. % $Al_2O_3$ sample of Example I without difficulty.

COMPARATIVE EXAMPLE VI

An additional comparative sample was prepared by gas pressure infiltration of loose ceramic powder of 10 micron average particle size SiC and commercially pure Mg liquid metal. The resulting Mg/40 to 45 vol. % SiC composite was turned on a lathe using a solid carbide tool bit. The lathe cut for only a few seconds, when the bit began to dull and merely push the material.

COMPARATIVE EXAMPLE VII

A further comparative sample was prepared using the same technique as described for Example VI with 3 micron average particle size SiC. An attempt was made to band saw the resulting Mg/40 to 45 vol. % SiC composite. The band saw quickly stopped in about 10 to 15 seconds without significant penetration into the matrix.

From the foregoing, it can be realized that this invention provides machinable, high modulus metal-matrix composites and metal infiltration techniques for preparing these composites. Critical parameters have been discovered which map the necessary ranges of volume fraction of porosity and particle size distribution necessary for low pressure metal infiltration and optimum mechanical properties. Although various embodiments have been illustrated, this was for the purpose of describing and not limiting the invention. Various modifications, which will become apparent to one skilled in the art, are within the scope of this invention described in the attached claims.

What is claimed is:

1. A method for manufacturing a machinable metal-matrix composite comprising the steps of:

providing a colloidal slurry of ceramic particles in a liquid wherein substantially all of the said particles have a particle size of no greater than about 1 micron;

separating the ceramic particles from the liquid to provide a ceramic preform having a substantially uniform distribution of ceramic particles and sintering the ceramic particles to one another;

disposing of said ceramic preform into a mold;

contacting said ceramic preform with a molten metal;

causing said molten metal to penetrate into said preform; and permitting said molten metal to solidify to form a machinable metal matrix composite.

2. A method for manufacturing a machinable metal-matrix composite in accordance with claim 1 wherein the steps of providing a colloidal slurry of ceramic particles in a liquid and separating the ceramic particle from the liquid to provide a substantially uniform distribution of ceramic particles wherein at least 80% of the ceramic particles are uniformly distributed on a scale of three times the particle size.

3. A method for manufacturing a machinable metal-matrix composite in accordance with claim 2 wherein at least about 90% of the ceramic particles are uniformly distributed on a scale of twice the particle size.

4. The method of claim 3 wherein said colloidal slurry is subjected to a milling step.

5. A method for manufacturing a machinable metal-matrix composite in accordance with claim 2 wherein the step of causing said molten metal to penetrate into said preform is accomplished by pressure infiltration.

6. The method of claim 5 wherein said ceramic preform includes about 50 to 85% porosity by volume.

7. The method of claim 5 wherein said ceramic preform consists of 60 to 80% porosity by volume.

8. The method of claim 5 wherein said composite comprises a tensile modulus which is at least about 30 to 200% greater than the tensile modulus of said metal.

9. The method of claim 5 wherein said providing step comprises filtering, extruding, pressing or slip casting a precursor of said particles to produce a green preform.

10. The method of claim 5 wherein said causing step comprises molten metal infiltration, whereby said molten metal is forced into the pores of said preform by a pressurized gas.

11. The method of claim 10 wherein said pressurized gas has a pressure of about 1,000 to 3,000 psi, and said preform has a compressive strength of at least about 500 psi.

12. A method of manufacturing a metal-matrix composite comprising the steps of:

providing a colloidal slurry of ceramic particles in a liquid wherein substantially all of said particles have a particle size of no greater than about 1 micron;

forming a ceramic preform consisting essentially of a substantially uniform distribution of submicron ceramic particles bonded to one another by separating the ceramic particles from the liquid and bonding the particles together at their points of contact;

disposing said ceramic preform into a mold;

contacting said ceramic preform with a molten metal driving said molten metal into said preform by pressure infiltration so as to cause said molten metal to penetrate into the pores of said preform without disrupting said preform; and permitting said molten metal to solidify to form a machinable, solid metal-ceramic composite.

13. The method of claim 12 wherein said ceramic particles comprise: an oxide, boride, nitride, carbide, carbon, silicide, sulfide, oxysulfide or a mixture thereof.

14. The method of claim 12 wherein said providing step comprises filtering a precursor of said ceramic particles to provide a green preform.

15. The method of claim 12 wherein said solid metal-ceramic composite comprises a near net shape.

16. The method of claim 12 wherein said providing step comprises mixing said ceramic particles with up to about 70 vol. %, based upon the volume of dry ingredients, of a filler, binder or mixture thereof.

17. The method of claim 16 wherein said providing step comprises firing said ceramic particle mixture to sinter said particles.

18. The method of claim 17 wherein said driving step comprises forcing said molten metal into said preform by an inert gas pressure of about 1,500 to 2,500 psi.

19. A method of manufacturing a machinable metal-matrix composite, comprising the steps of:

providing a colloidal slurry of ceramic particles in a liquid wherein substantially all of said particles have a particle size no greater than about 1 micron;

separating the ceramic particles from the liquid to provide a ceramic preform having a substantially uniform distribution of ceramic particles and sintering the ceramic particles to form particle to particle bonds so that said particles are substantially thermally and chemically stable for the time and temperature of the manufacturing method and the environmental conditions of service, said particles further comprising: an oxide, boride, nitride, carbide, carbon or a mixture thereof and a compressive strength of at least about 500 psi;

disposing said ceramic preform into a mold;

contacting said ceramic preform with a molten metal selected from a group consisting of: Al, Li, Be, Pb, Ag, Au, Sn, Mg, Ti, Cu, Zn or a mixture thereof;

forcing said molten metal into said ceramic preform so as to penetrate into said preform; and permitting said molten metal to solidify to form a solid metal-ceramic composite which includes a tensile modulus which is at least about 30% greater than the tensile modulus of said metal.

20. The method of claim 19 wherein said providing step comprises: pressure filtrating a precursor of said ceramic particles with a graphite filler; suspending said filtered particles with the graphite filler and inorganic binder to form a green preform; and firing said green preform to remove said filler, whereby a portion of said ceramic particles are sintered to one another.

21. The method of claim 19 wherein said forcing step comprises evacuating a gas from said preform by an applied vacuum, and forcing said molten metal into the pores of said preform with a pressurized argon-containing gas.

* * * * *